US005649526A

United States Patent [19]

Ellig

[11] Patent Number: 5,649,526

[45] Date of Patent: Jul. 22, 1997

[54] BOW SIGHT PIN

[76] Inventor: Mike Ellig, 1332 Bluebird La., Bozeman, Mont. 59715

[21] Appl. No.: 561,000

[22] Filed: Nov. 21, 1995

[51] Int. Cl.[6] ..... F41G 1/467

[52] U.S. Cl. ..... 124/87; 33/265

[58] Field of Search ..... 124/87; 33/265

[56] References Cited

U.S. PATENT DOCUMENTS

| | | | |
|---|---|---|---|
| 802,277 | 10/1905 | Fric | 33/241 |
| 3,184,851 | 5/1965 | Simmons | 33/241 |
| 3,945,127 | 3/1976 | Spencer | 33/265 |
| 4,070,763 | 1/1978 | Carts | 33/241 |
| 4,166,324 | 9/1979 | Carollo | 33/241 |
| 4,170,071 | 10/1979 | Mann et al. | 33/265 |
| 4,177,572 | 12/1979 | Hindes | 33/265 |
| 4,220,983 | 9/1980 | Schroeder | 362/114 |
| 4,309,827 | 1/1982 | Larson | 3/265 |
| 4,325,190 | 4/1982 | Duerst | 33/265 |
| 4,400,887 | 8/1983 | Mason | 33/265 |
| 4,928,394 | 5/1990 | Sherman | 33/265 |
| 4,977,677 | 12/1990 | Troescher | 33/265 |
| 5,122,932 | 6/1992 | Ziller | 362/32 |
| 5,168,631 | 12/1992 | Sherman | 33/265 |
| 5,201,124 | 4/1993 | Sherman | 33/265 |
| 5,231,765 | 8/1993 | Sherman | 33/241 |
| 5,435,068 | 7/1995 | Thames et al. | 33/265 |
| 5,442,861 | 8/1995 | Lorocco | 33/265 X |

*Primary Examiner*—John A. Ricci

[57] ABSTRACT

An improved light gathering sight pin for use with an archery bow. The sight pin including a protective cover holding a light gathering fiber material. The protective cover having a threaded exterior of the same general shape as a conventional sight pin that is used by screwing the protective cover into a bow sight holder. The protective cover including a slot for receiving the light gathering fiber. The slot allowing light to be transmitted to and be absorbed by the light gathering fiber when the fiber is positioned within the slot. The elongate light gathering fiber when positioned within the slot extends out one end of the protective cover. The fiber is curved toward the user whereby a sight bead, comprising the end surface of the light gathering fiber element, is presented to the user.

3 Claims, 3 Drawing Sheets

BOW SIGHT PIN

BACKGROUND OF THE INVENTION

This invention relates to an improved sight pin using a light gathering fiber for use with a bow.

Before the advent of sight pins, archers sighted bows by aligning the tip of the arrow with a reference point correlated with the target. Modern archery utilizes multiple sight pins mounted to the bow with each sight pin being correlated with a particular range to a target. The sight pins include colored sight beads for easy viewing by the archer. Thus sight beads permit an archer to vary the aim in range to the target by virtue of the archer placing an appropriate sight bead on the target.

Several problems have been encountered in using conventional sight pins. Since sight pins extend outward from a sight pin holder, they can be easily broken when the bow is pulled through brush and undergrowth. An unyielding branch places considerable force on a sight pin when the branch becomes enmeshed in this portion of a bow. In hunting situations, an offending branch can easily snap a sight pin off just before an archer may want to use his bow. It is a major concern for a hunter to carry an appropriate number of spare sight pins.

In low light conditions it is difficult for an archer to simultaneously see both the sight bead and a target. Eye focus of the archer is generally on the target which makes the sight bead look like a blurry point in the archer's near vision. Under these low light conditions, the archer may not even be able to see a conventional sight bead as he aims his arrow. Several patents have addressed this problem by having illuminated sight beads, for instance see U.S. Pat. No. 4,166,324, U.S. Pat. No. 4,170,071, and U.S. Pat. No. 4,177,572. These patents all illustrate sight beads that glow in some manner by using a battery to force the "glowing".

U.S. Pat. No. 5,201,124 illustrates a technique for illuminating a sight bead without using a battery. Light is gathered by using a large diameter light collecting plastic member to gather incident light falling on the large area of the light collecting member. This large light collecting member is then tapered down to the small size of the sight bead so that a substantial portion of all the gathered light can exit with an increased intensity through the small area of the sight bead.

Other references utilizing light collecting members including fiber optic members to illuminate a sight bead are U.S. Pat. No. 5,442,861, U.S. Pat. No. 5,231,765, and U.S. Pat. No. 4,928,394. The fiber optic strand in U.S. Pat. No. 5,442,861 is held in a tubular sleeve which in turn is mounted to a bow. In this sight, a lens is provided at the sight bead end of the fiber optic element. The fiber optic strand in U.S. Pat. No. 5,231,765 is fed by a plastic light collector and the fiber optic strand in U.S. Pat. No. 4,928,394 collects light due to the long length of fiber optic material extending away from the sight pin.

From the above it can be seen that what is needed in a fiber optic sight pin and bead that is easily replaced when broken, is small for easy storage and handling, has structural integrity so as not to be broken easily, and collects light in a much more compact volume than heretofore known.

SUMMARY OF INVENTION

The present invention relates to an improved light gathering fiber sight pin and bead which uses ambient light for illumination of the sight bead. In one embodiment a protective cover, for holding a light gathering fiber material, has a threaded exterior of the same general shape as a conventional sight pin and is used by screwing the protective cover into a bow sight holder. The protective cover includes a slot for receiving the light gathering fiber. The slot allows light to be transmitted to and be absorbed by the light gathering fiber when the fiber is positioned within the slot.

The elongate, light gathering fiber when positioned within the slot extends out one end of the protective cover. The fiber is curved toward the user whereby a sight bead, comprising the end surface of the light gathering fiber element, is presented to the user. This combination permits light to pass through the slot and be absorbed along the entire length of the light gathering fiber. The light is then transmitted to the end surface of the fiber which, in each of the preferred embodiments, comprises the sight bead. The protective cover also serves to provide structural integrity for the light gathering fiber to prevent breakage. The cover being rigid also prevents bending of the light gathering fiber and thus provides a shooter with a more consistent aiming point. When a sight pin is to be replaced it is a simple matter to remove the damaged sight pin and replace it with a replacement pin.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF PREFERRED EMBODIMENTS

Figure 1:
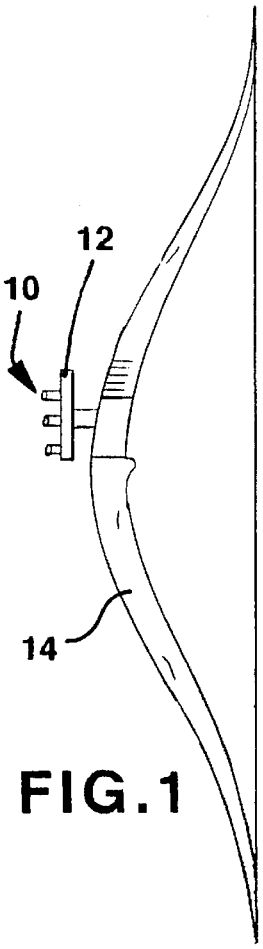
FIG. 1 is an elevational view of a conventional bow having a conventional bow sight with the improved sight pins of the present invention installed.

A first embodiment of the an improved sight pin 10 is shown in FIG. 1. Improved sight pins 10 are mounted on a conventional bow sight 12 having a slide extension 13 which in turn is mounted on a conventional bow 14. Bow sight 12 has an upright guide 16 to which multiple sight pin carriers 18 slideably engage the edges thereof. A clamping bolt 20, extending completely through sight pin carrier 18 to threadably engage an opposite edge, clamps the sight pin carrier to the upright guide 16. Multiple sight pin carriers 18 can be clamped in this same manner so as to present a sight bead at different elevations along the upright guide.

The improved sight pin 10 threadably engages sight pin carrier 18 and is sized to extend completely through the sight pin carrier. A lock nut 22 threadably engages sight pin 10 to hold the sight pin at the position selected which will be the horizontal component of aiming of bow sight 12 when bow 14 is held vertically.

Improved sight pin 10 has a rigid, elongate, protective cover 24 covering substantially the entire length of light gathering fiber 28. Protective cover 24 is preferably constructed of a polycarbonate plastic material. Protective cover 24 has a slot 26 extending along and parallel to a longitudinal axis and is sized to frictionally hold a light gathering fiber 28. Protective cover 24 is sized to have an exterior diameter of about four times the exterior diameter of light gathering fiber 28. The protective cover serves to provide structural strength for light gathering fiber 28 whereby breakage of the fiber is reduced. In addition, protective cover 24 can be easily manufactured to have the slot 26 to receive fiber 28. This is a major improvement over protective covers having an axial bore for receiving a light gathering fiber. Ambient light passes through the slot 26 and is absorbed by light gathering fiber 28.

Protective cover 24 is threaded on an exterior surface so as to be threadably received by sight pin carrier 18 and lock nut 22.

The optical characteristics of a light gathering fiber are such that most light received by the light gathering fiber is transmitted along the fiber internally and then emitted from the abrupt ends of the fiber.

In a preferred embodiment, light gathering fiber 28 has a portion extending beyond an end of protective cover 24. This is smoothly turned in a direction substantially perpendicular to the longitudinal axis of the remaining portion of the light gathering fiber. The end face of the turned end of light gathering fiber 28 forms a sight bead 30 that can be directed at an archer's eye. The protective cover 24 is sized to stop short of the turned end of light gathering fiber 28 so that there will be little visual interference with the sleeve and the sight bead when an archer uses this sight. Light gathering fiber 28 can also be colored with an appropriate dye to change the color of light emitted from sight bead 30. Sight bead 30 glows because light absorbed by light gathering fiber 28 is transmitted to the sight bead 30. Since protective cover 24 substantially surrounds light gathering fiber 28, the whole device is very compact. Further, protective cover 24 provides structure for supporting substantially the entire length of light gathering fiber 28 to reduce breakage of this fiber and is mounted to a bow sight directly without the need of additional hardware.

In operation, a sight pin 10 having a light gathering fiber 28 of an appropriate color is inserted into sight pin carrier 18 with sight bead 30 spaced apart from the sight pin carrier to compensate for any horizontal errors as sight bead 30 is placed on a target. Lock nut 22 is then tightened on protective cover 24 to hold bow sight 12 in horizontal registration and with sight bead 30 directed toward an archer's eye when the bow is correctly held. If an adjustment in elevation registration is required, clamping bolt 20 is loosened, sight pin carrier 18 moved on upright guide 16, and then clamping bolt 20 tightened again.

If a sight pin breaks, the archer needs only to discard the remains of the old sight pin, and thread a replacement sight pin 10 into sight pin carrier 18 as described in the paragraph above.

In addition, because protective cover 24 substantially encircles light gathering fiber 28 between the ends of the light gathering fiber, the improved sight pin is compact with the light gathering capability positioned adjacent the sight bead. Light is transmitted through slot 26 to light gathering fiber 28 while light gathering fiber 28 absorbs the light and transmits it to a glowing sight bead 30.

Figure 2:
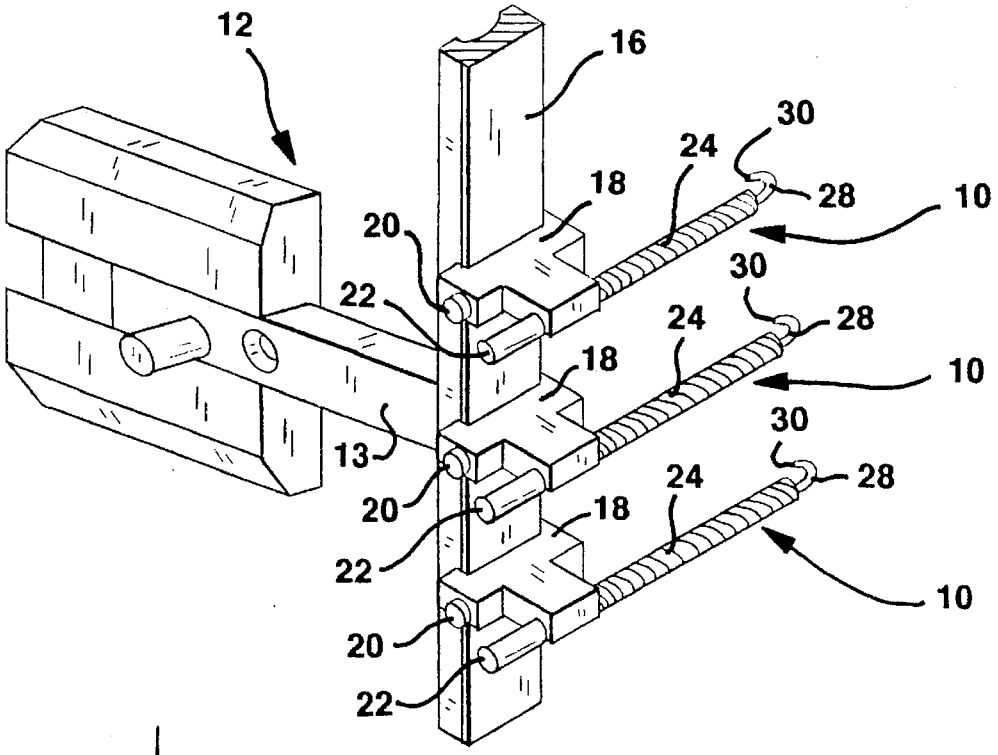
FIG. 2 is a perspective view of a conventional bow sight having the improved sight pins of a first embodiment of the present invention installed.
Figure 5:
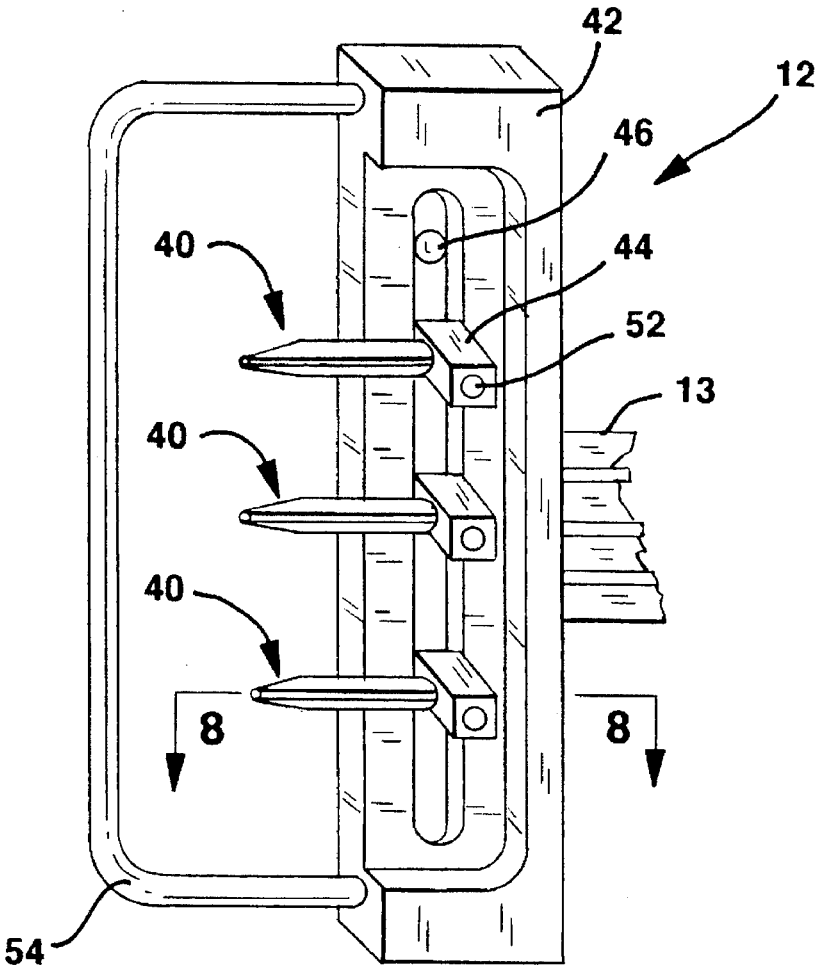
FIG. 5 is a perspective view of a conventional bow sight having the improved sight pins of a second embodiment of the present invention installed.
Figure 8:
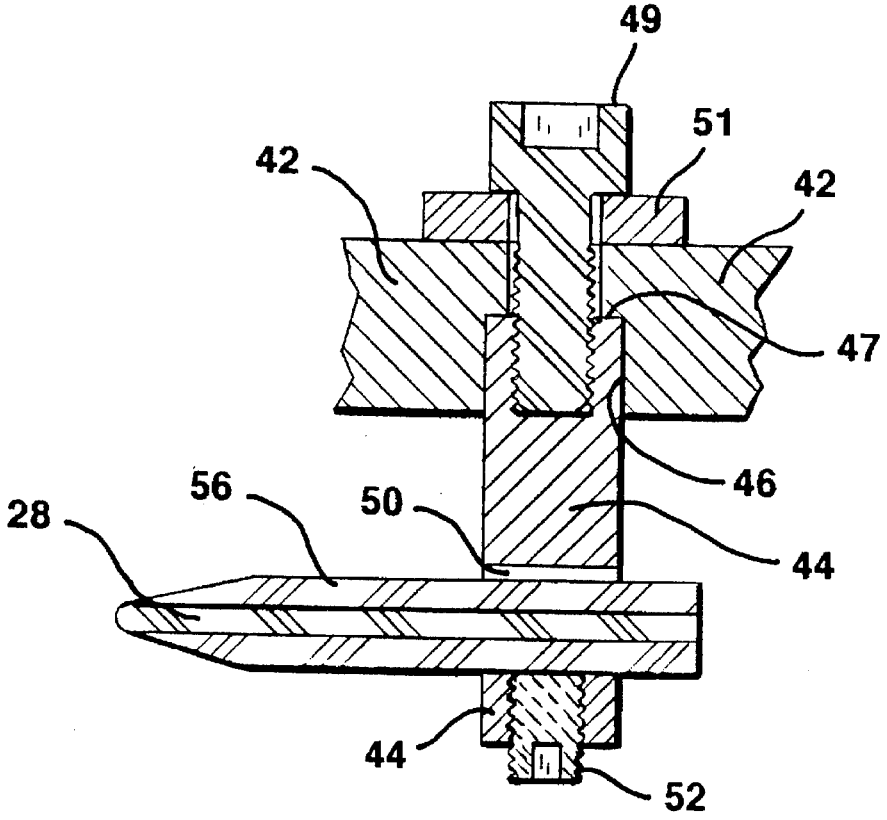
FIG. 8 is a cross-sectional view of the second embodiment with parts broken away taken along line 8—8 in FIG. 5.

A second embodiment of an improved sight pin 40 is shown in FIG. 5 and is mounted on a conventional bow sight 12 having a slide extension 13 as shown in FIGS. 2 and 5. The conventional bow sight 12 is in turn mounted to a conventional bow 14 as shown in FIG. 1. Bow sight 12 has an upright guide 42 with slot 46 in which multiple sight pin carriers 44 are slideably positioned. As shown in FIG. 8, the slot 46 has an internal ledge 47 against which ledge 47 the carrier 44 abuts. To rigidly maintain the carrier 44 at a preselected position, an Allen screw 49 is positioned through washer 51 and threaded into a threaded bore of carrier 44. Multiple sight pin carriers 44 can be clamped in this same manner so as to present sight beads at different elevations along the upright guide.

Figure 6:
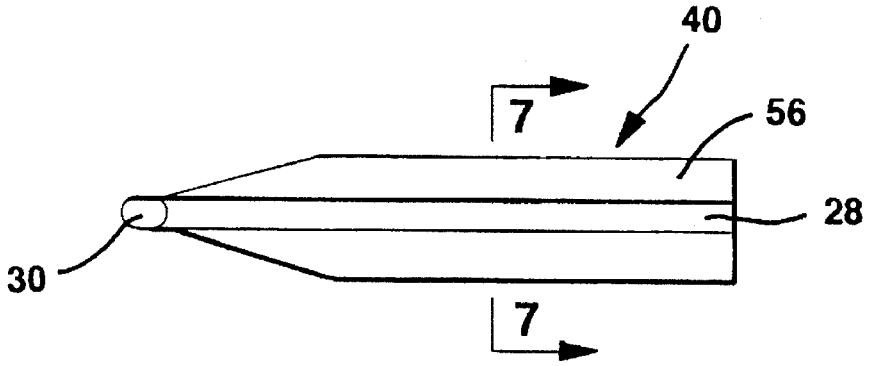
FIG. 6 is an elevational view of an improved sight pin according to the second embodiment of the present invention.
Figure 7:
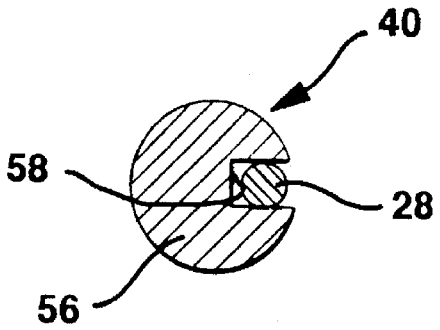
FIG. 7 is a cross-sectional view of the second embodiment taken along line 7—7 in FIG. 6.

The improved sight pin 40 as shown in FIGS. 5, 6 and 7 has a circular cross-section and is positioned in transverse hole 50. When the sight pin 40 is positioned at the desired extension it is clamped in place with set screws 52 as shown in FIG. 8.

Sight pins 40 are further protected from breakage by guard 54 secured to an upright guide 42.

Improved sight pin 40 include a protective cover 56 having a slot 58 extending along and parallel to the longitudinal axis of protective cover 56 and sized to frictionally hold a light gathering fiber 28. Ambient light passes through slot 58 and is absorbed by light gathering fiber 28 as was the case with the first embodiment.

Figure 3:
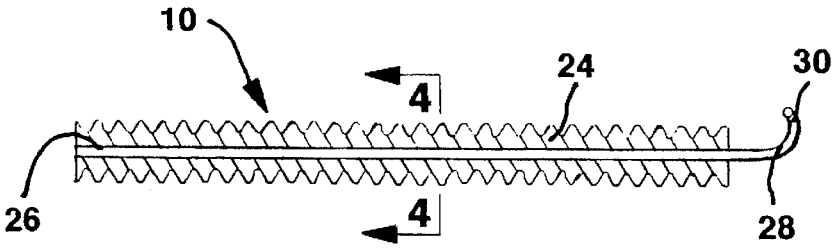
FIG. 3 is an elevational view of an improved sight pin of the first embodiment of the present invention.
Figure 4:
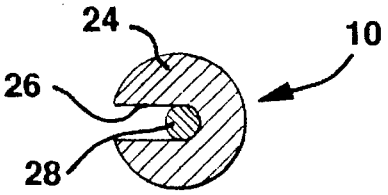
FIG. 4 is a cross-sectional view of the present invention taken along the line 4—4 in FIG. 3.

In this embodiment, protective cover 56 is tapered at one end and light gathering fiber 28 has a portion extending beyond the tapered end of protective cover 56. The extending end of light gathering fiber 28 is smoothly turned in a direction substantially perpendicular to the longitudinal axis of the remaining portion of the light gathering fiber. The end face of the turned end of the light gathering fiber 28 forms a sight bead 30, similar to that shown in FIG. 3, that can be directed at an archer's eye. The taper of protective cover 56 is provided so that there will be little visual interference with the protective cover and the sight bead when an archer uses this sight. Light gathering fiber 28 can also be colored with an appropriate dye to change the color of light omitted from sight bead 30. In operation, sight pin 40 is used as described above with respect to the first embodiment.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. An improved sight pin for use with a bow sight holder having a threaded cover receiving means comprising:

an elongate light gathering fiber;

a rigid elongate protective cover having length and ends and a light gathering fiber receiving slot extending in a direction parallel to a longitudinal axis of the cover for receiving and frictionally holding the elongate light gathering fiber;

the protective cover extending substantially the entire length of the light gathering fiber;

the light gathering fiber positioned within the light gathering fiber receiving slot but extending out one end of the protective cover;

the extending end of the light gathering fiber terminating in a sight bead; and the protective cover being threaded on an external surface to be threadably received by the cover receiving means.

2. The improved sight pin according to claim 1 wherein the extending end of the light gathering fiber is curved to present the sight bead in a direction perpendicular to a longitudinal axis of the light gathering fiber.

3. An improved sight pin for use with a bow sight holder having cover receiving means comprising:

an elongate light gathering fiber of uniform diameter;

a rigid elongate protective cover having length and ends and a light gathering fiber receiving slot extending in a direction parallel to a longitudinal axis of the cover for receiving and frictionally holding the elongate light gathering fiber;

the protective cover extending substantially the entire length of the light gathering fiber and having a tapered end;

the light gathering fiber positioned within the light gathering fiber receiving slot but extending out the tapered end of the cover;

the extending end of the light gathering fiber terminating in a sight bead; and securing means for securing the cover within the cover receiving means at a predetermined position.

* * * * *